US005105567A

United States Patent [19]

Real

[11] Patent Number: 5,105,567

[45] Date of Patent: Apr. 21, 1992

[54] QUICK CHANGE PLURAL DISPLAY DEVICE

[76] Inventor: Michael E. Real, 3938 Woodruff Ave., Oakland, Calif. 94602

[21] Appl. No.: 570,517

[22] Filed: Aug. 21, 1990

[51] Int. Cl.[5] ..... B44C 5/02

[52] U.S. Cl. ..... 40/158.1; 40/152

[58] Field of Search ..... 40/152, 611, 158.1, 40/159.2, 5, 159, 156

[56] References Cited

U.S. PATENT DOCUMENTS

| | | | |
|---|---|---|---|
| 758,088 | 4/1904 | Mixer | 40/611 |
| 1,017,563 | 2/1912 | Lain et al. | 40/611 |
| 1,668,378 | 5/1928 | Pickett | 40/611 |
| 2,587,434 | 2/1952 | Boaden et al. | 40/159.2 |
| 2,643,577 | 6/1953 | Williams | 40/159 X |
| 2,803,077 | 8/1957 | Baireuther | 40/152 |
| 3,063,338 | 11/1962 | Bregman | 40/159 X |
| 3,705,464 | 12/1972 | Dahl, Jr. | 40/159 X |
| 3,813,799 | 6/1974 | Caravello | 40/152 |
| 4,424,637 | 1/1984 | Leahy | 40/158.1 |
| 4,679,341 | 7/1987 | Goldman | 40/158.1 |
| 4,916,838 | 4/1990 | Holson | 40/159 |

FOREIGN PATENT DOCUMENTS

| | | | |
|---|---|---|---|
| 144725 | 1/1931 | Switzerland | 40/611 |
| 401628 | 11/1933 | United Kingdom | 40/152 |

*Primary Examiner*—Kenneth J. Dorner
*Assistant Examiner*—Brian K. Green
*Attorney, Agent, or Firm*—Harry A. Pacini

[57] ABSTRACT

A display device for receiving and displaying various flat objects, such as photos, in which display enevelopes cooperate with guide rails and said envelopes containing the displayed items are easily inserted and removed through envelope insert slots in the edge of the frame of the display device; said display device having a frame, a back support panel, a guide means associated with said back panel and cooperating with said insert slots, an inset overlay and an inset transparent viewing member; the insert slots in the edge of the frame are finished so as to conform to the edge of the frame and give the frame a finished appearance.

7 Claims, 2 Drawing Sheets

QUICK CHANGE PLURAL DISPLAY DEVICE

The present invention relates to an improved plural display device having means for quickly and easily changing or rearranging the display therein. Said display may include, though not limited to, photos, printed matter, various objects, flat items and the like.

BACKGROUND AND DISCUSSION OF PRIOR ART

Various display devices are described in the prior art for display of signs, photography and the like. The structural orientation and element analysis will quickly distinguish the instant invention over these apparata. Among the prior art devices, which rely upon a disclosure wherein utilization of modular display apparatus and replacement or maintenance ability is available, include some of the following that have been found to be most relevant.

U.S. Pat. No. 4,682,430 (Ramsay, C. F.) relates to signs as used for price chips used in menu and price display structures as in fast food restaurants. In '430 individual price chips are removed and inserted at the front of a support strip. The prior art structure allegedly reduces error occurrence in the arrangement of a pricing indicia in contrast to rear installation and removal of price chips.

U.S. Pat. No. 1,068,621 (Abraham, A.) relates to an interchangeable picture frame having a display opening and a pocket on the rear of the frame for receiving movable cards or pictures for display in the front opening of the picture frame. Similarly, U.S. Pat. No. 2,839,857 (Teller, O.) relates to a multiple frame for interchangeable pictures. The picture frame of '857 permits picture changing in the same frame with pictures of different sizes.

U.S. Pat. No. 4,679,341 (Goldman, J. G.) relates to a modular display apparatus for sign panels for receiving and displaying sign panels, in which panel support elements cooperate with elevated ridges and frame overlay. The overlay forms sign panel regions in which sign panels may be inserted. In general '341 relates to advertising and/or information sign apparatus for modular displaying sign panels in slidable modular flat panel supports behind an overlay frame. The overlay frame creates the location of the insert.

U.S. Pat. No. 3,813,799 (Caravello) relates to a picture frame for framing and holding a plurality of pictures in predetermined orientation. The picture frame comprises a back support frame, an intermediate frame having a plurality of pockets for receiving the pictures, and a front support frame with openings for display of the pictures. The pictures are inserted in and removed from a picture holding frame. The picture holding frame then is inserted into a conventional frame.

With the present invention, there is no need for dismantling an outer frame or holding means to insert or change pictures in a frame for framing and holding a plurality of pictures. In accordance with the present invention wherein the photos or pictures are inserted and manipulated for display, with ease, without error for arrangement, with positive and exact positioning.

An object of the present invention is to provide convenient and easy means to insert and remove photos or other flat display items from a photo frame having plural openings for display of the photos or other items.

Therefore, it is an object of the present invention to provide for a support guide means for positioning display envelopes.

Still another object of this invention is to provide a support structure within a plural display photo frame for guiding a photo holding removable display envelope.

Yet another object of the invention is to provide a frame display device for plural photos, pictures, flat items, and the like with ease of removal and insertion of display items without dismantling the frame.

Although photos or photographs are often referred to in this application, it is to be understood that any flat item or object may be inserted into and displayed in the device of the present invention. More specifically, the following are examples that may be included baseball cards, postal covers, photo post cards, ornamental designs, art work, messages and the like.

Other features and advantages of the present invention will become apparent to those skilled in the art to which the invention pertains during the course of the following description of the drawings.

SUMMARY OF THE INVENTION

The present invention comprises a modular display framing apparatus for slidably receiving, maintaining and displaying one or more flat multi-sided displayed objects in one or more display envelopes. The display apparatus comprises one or more substantially horizontal support means for positioning the substantially flat displayed objects in a configuration held by removable display envelopes. Further, this invention relates to a frame and display configuration in which each of the substantially horizontal envelope support means is of a size substantially equivalent in length to that of the flat overlay mask panel positioned in front of said displayed object.

However, an alternative embodiment of said envelope support structure permits various sizes and non-linear or random positioning of the display openings of the conforming overlay mask by means of support and guides of non-rectangular or irregularly shaped photo display envelopes. Therefore, the photo support structure may resemble various cooperating shapes, orientations or configurations, all of which are consistent with and adaptable to the present invention with no single or exclusive style, location, position or configuration intended to be a limiting factor.

Within the preferred embodiment a plurality of spaced ridge supports as display envelope supports are operably affixed to the front of the rear panel or optionally to the rear of the front frame panel support means projecting rearwardly therefrom. Then in each instance the projection is towards and beyond the position of the sliding display envelope containing the objects to be displayed. The elevated ridge supports are positioned to engage the lower or resting edge of the sliding display envelope.

As a preferred embodiment the plurality of the elevated envelope supports serve to restrain and position the display envelopes therewithin in positioned arrangement to the respective support and the full front mask overlay. A display envelope has two ends. Said ends of the display envelope are not butted to a sealing side, however the side openings are so configured as to enable slidable reciprocating movement of the display envelope into and out of the display frame on the spaced ridge supports. The front frame of the display device may be slotted on one side or on both sides for receiving the envelope. The preferred display frame side slot arrangement for receiving the display envelopes is with slotted openings on both sides of the frame.

In a preferred embodiment, the apparatus of the instant invention further comprises a back cover comprising a back panel member which is operably attached to the front frame and together therewith enclosing the display envelope, mask and glass.

Also, in the preferred embodiment of the invention the plurality of elevated spaced support ridges are integrally formed with and extruded from a single sheet of formable material. In the alternative, unitary spaced support and guide ridges are securely attached to the inside of the overlay front frame or back panel. To one skilled in the art a spaced array of guide points may be used to support and guide the display envelope within the display device. Additionally, in the preferred embodiment a front overlay masking member comprises an integrated overlay masking means fabricated from a single sheet of material. The front overlay mask has a plurality of openings patterned therein to correspond to the display envelope configuration.

The back panel support means and corresponding elevated spaced ridge supports and the front overlay masking member together with the aperture means formed therewithin are of a substantially equivalent rectangular geometric shape, although circular or elliptical geometric shapes can be adapted to function within the described embodiments.

DETAILED DESCRIPTION OF THE INVENTION

Figure 1:
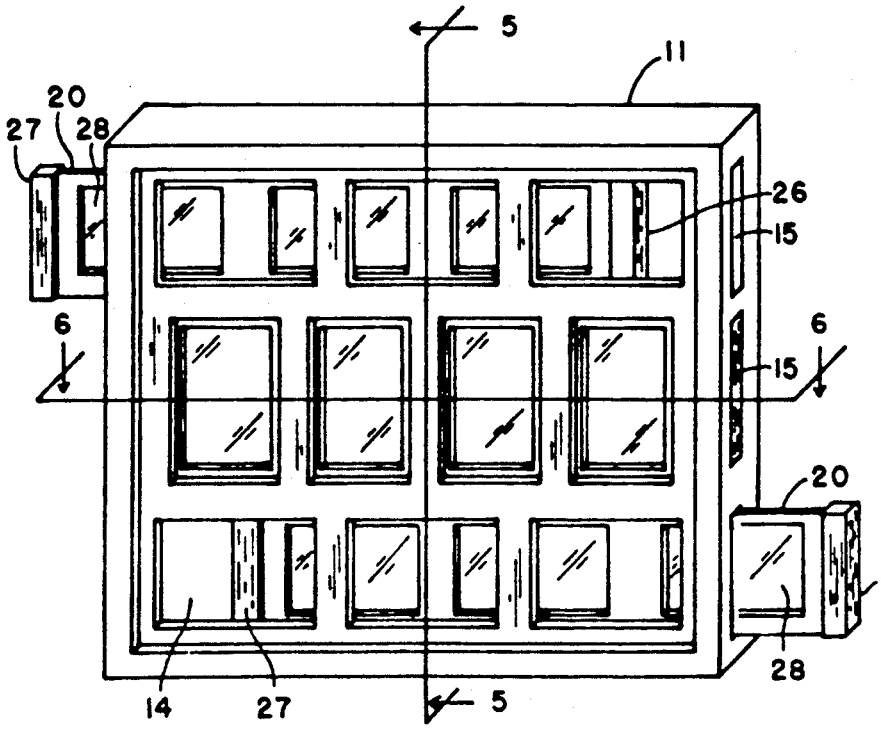
FIG. 1 is a front elevation of a plural display frame according to the present invention, in particular, placement of the item holding envelopes with a receiving region formed by the front fame, guide supports and back cover plate.
Figure 2:
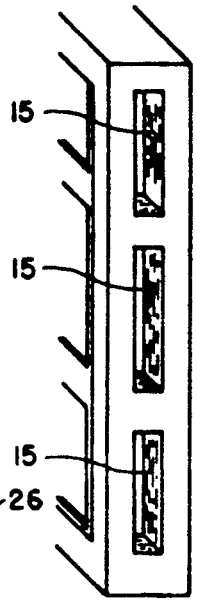
FIG. 2 is a side elevation view of the plural display frame of FIG. 1 showing the relationship of the side openings and structural elements of the device.
Figure 3:
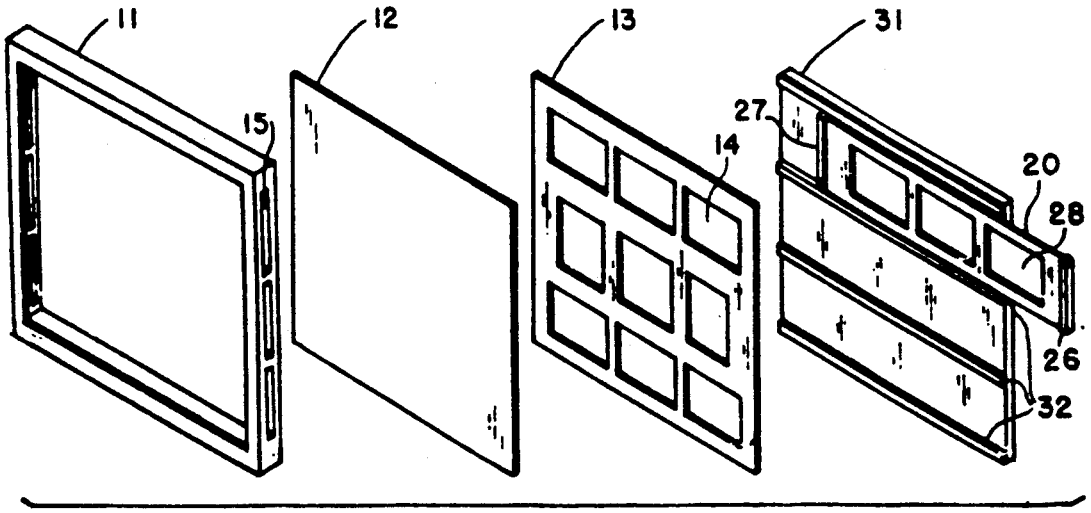
FIG. 3 is an exploded perspective view from the top and side of the plural display frame showing the elements thereof.

Referring to the drawings in detail, in the form of the invention shown in FIGS. 1–6, the front frame overlay designated 11 may be constructed consistent with several embodiments of this invention. That is, as shown in FIGS. 1 and 3 the front frame 11 is a border with one large opening through the center portion thereof for display of the overlay mask member 13. The overlay mask member 13 has various multiple openings 14 therein for display of photographs and the like as described hereinabove. The display device of this invention comprises the frame 11 which wraps around the sides to accommodate the enclosure of a transparent protector 12, the mask overlay insert 13, and display envelope 20 for holding the items to be displayed.

The modular display device 11 of this invention can further be viewed by FIGS. 2 and 3, wherein in the exploded perspective view of FIG. 3 there is disclosed guide rails 32 upon which the display envelopes 20 are supported when in place in the frame structure. The elements of the device can be defined as follows: wherein the frame 11 overlaps the transparent protector 12 over the mask overlay 13 through which the exhibited items are viewed. The back cover 31 carries envelope guide rails 32 as means to support the inserted display envelope 20.

The back cover 31 is substantially flat with means for supporting and guiding the display envelope, as by raised transverse support guide rails 32. The support guide rails 32 are in substantial parallel relationship either in horizontal or vertical orientation; formed on the front side of the back cover 31 and projecting forwardly toward the front mask overlay insert and engaging therewith. The support guide rails 32 support the display envelope 20 and space the back cover 31 away from the mask overlay insert 13. In this manner the space is formed and maintained to permit the envelope 20 to slide into the space between the mask 13 and the back cover 31.

The front frame 11 comprises overlay segments which form the perimeter of the frame with the side segments—a first side and a second opposing side, there is optionally provided a plurality of opening slots 15 cooperating with guide rail supports 32 on the back cover 31. The slots 15 together with the guide rail supports 32 accommodate the envelope 20 therethrough.

Figure 4:
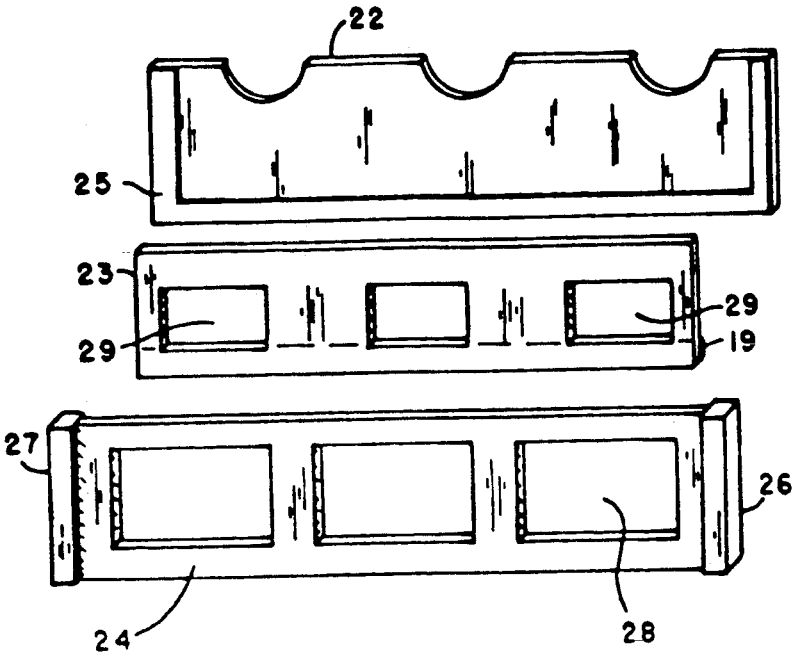
FIG. 4 is an exploded front elevation view of slide envelope showing the elements thereof.
Figure 5:
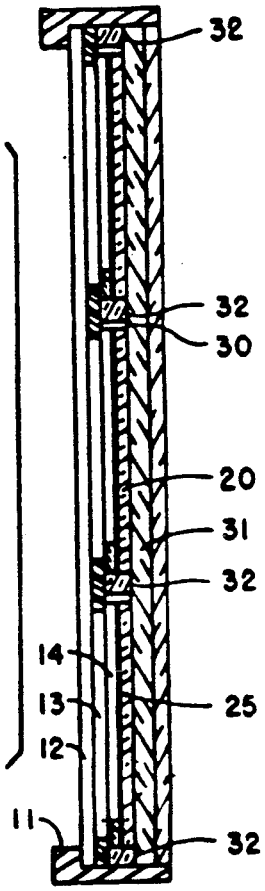
FIG. 5 is an elevated cross-section view taken along lines 5—5 in the direction of the arrows in FIG. 1 showing the structural relationship of the various structural elements.

The envelope 20 as seen in FIG. 4 comprises an envelope front 24 having a plurality of openings 28 for display of the display items therethrough. Also provided is an insert envelope mask 23, such an insert mask is provided to accommodate varying size display items, said insert mask 23 is provided with attached bottom and spacing means 19. The envelope back 22 supports and completes the closure of the envelope. The ends of the envelope are sealed by end caps 26 and 27. Preferably an end cap is connected to each end of the envelope.

Within the envelope construction is a spacer and sealing means such as, a tape for holding or sealing the side edges and lower edges closed. The spacer means is used to hold apart the front and back of the envelope to allow the displayed item to be inserted or removed more easily.

Among further embodiments to enhance the utility of the instant invention, to those skilled in the art, the following will be easily modifiable and functional. Rather than side entrance slots, top and/or bottom envelope entrance slots with appropriate locking means to hold the envelopes in place can be used.

Also considered in the design of the envelope entrance slots positioned only on one side, optionally right or left, for single sided entry. Therefore, in this configuration the opposite side of the frame will be sealed or closed. Also within the instant invention is the possibility of a single or double picture or item displayed. With the accompanying ease of changing the items on display, also various envelope removal means are contemplated such as, knobs, slots, spring bias, and the like are useable to assist in removing the envelope 20.

When said envelope 20 is in place in the slot 15 provided therefor, the end caps 26 and 27 are shaped and sized to cooperate with the display envelope and slot 15 in the side of the frame 11. That is, when in position the end caps are flush with the side segments of the frame 11. Therefore, in the preferred embodiment the end caps are capable of passage therethrough, when pushed from the opposite side. This permits the envelope unit to be removed by pulling the ejected envelope from the opposite side.

Other means for aiding in removing an inserted display envelope includes, among others, a spring biasing means inside the frame edge biasing the envelope. Whereby a tap or slight push on the envelope capped end will cause the release and partial ejection of the envelope assembly from the frame. In another aid, an opposite end push pin or knockout for pushing the envelope out of the slot through a corresponding slot on the other side or end of the frame can be employed. The end of the envelope is preferably finished so as to match the edge of the frame in color, texture, finish and appearance. Also, the envelope can be unfinished, but a finishing cap is placed over the unfinished end. Another envelope removal aid is, for example, a small angled slot across the face of the end cap, said slot can be engaged by a finger nail or small tool, for example, for pulling the attached envelope from the display slot in the side of the frame.

Figure 6:
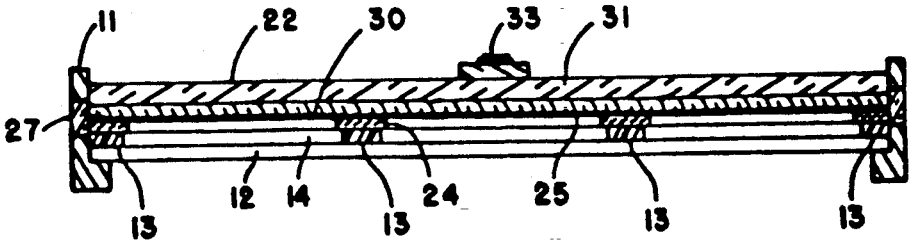
FIG. 6 is an elevated cross-section view taken along line 6—6 in the direction of the arrows in FIG. 1.

In yet another embodiment FIG. 6 the front mask overlay 13 is an integral part of the front frame overlay 11. To those skilled in this art it will be recognized, that this embodiment limits only the configuration and arrangement of the display of plural images through the front of the display device. Therefore, for further variety of the display the separated front frame 11 and front mask overlay 13, which can be changed for varied display of plural images is preferred. Notwithstanding the selection of front 11 frame with a permanent mask, or the selection of front frame 11 with a novel and independent insert mask overlay, the means for inserting, changing and displaying images in the device of the present invention will be consistent with and the equivalent with that as described herein.

The back support means 31 is substantially the same size as the mask overlay 13 and the front frame 11, so that each of these elements cooperate one with the other. These component parts are such that they can be joined together to form a unitary display device for multiple images, whether nesting or surface mounted. Said back support means may have attached thereto means for hanging or otherwise supporting the frame and contact either as a wall hanging or as a table top display support.

While this invention is susceptible of embodiments in many different forms, there is shown in the drawings and herein described in detail, several specific embodiments, with the understanding that the present disclosure is to be considered as an exemplification of the principles of the invention and is not intended to limit the invention to the embodiments illustrated.

What is claimed is:

1. A display device comprising a) a frame member having a top side and a bottom side and two opposing sides therebetween, and having insert slots in opposite sides of said frame;

b) a back support member having guide means attached thereto and cooperating with said insert slots in at least one of the opposite sides of the frame member;

c) a display envelope means for containing items to be displayed and inserted into said insert slots;

d) an inset masking means overlaying said display envelope means;

e) a transparent inset viewing member.

2. The device of claim 1 wherein said insert slots are finished to match to the cooperating edge of the frame.

3. The display device of claim 1 wherein said guide means are a plurality of elevated spaced support ridges.

4. The display device of claim 3 wherein said support ridges are integrally the back support member formed with and extruded from a single sheet of formable material.

5. The display device of claim 1 wherein said guide means are ridges engaging an inside of said inset masking means.

6. The display device of claim 1 wherein said inset masking means is a front overlay masking member set inside the frame member and overlaying said display envelopes.

7. The display device of claim 1 wherein said display envelope means contains within said envelope means a spacer positioning means to hold apart a front and back of the envelope means and to aid in rapid positioning of a display item therein.

* * * * *